US006170369B1

(12) United States Patent
Weinstein et al.

(10) Patent No.: US 6,170,369 B1
(45) Date of Patent: Jan. 9, 2001

(54) PORTABLE BATT CUTTER

(75) Inventors: Larry J. Weinstein; Robert J. Allwein, both of Littleton; John A. Fry, Conifer; Vern C. Plotts, Littleton; Jo M. Teague, Littleton; William H. Olbert, Littleton, all of CO (US)

(73) Assignee: Johns Manville International, Inc., Denver, CO (US)

( * ) Notice: Under 35 U.S.C. 154(b), the term of this patent shall be extended for 0 days.

(21) Appl. No.: 09/185,427

(22) Filed: Nov. 3, 1998

(51) Int. Cl.[7] ..... B26D 1/00
(52) U.S. Cl. ..... 83/13; 83/403.1; 83/649
(58) Field of Search ..... 83/13, 73, 311, 83/312, 403.1, 801, 589, 649, 369, 370, 650, 949; 53/429, 117

(56) References Cited

U.S. PATENT DOCUMENTS

| | | | | |
|---|---|---|---|---|
| 3,496,698 | * | 2/1970 | Wichmann | 53/117 |
| 3,673,757 | * | 7/1972 | Willis | 53/21 FW |
| 3,728,921 | * | 4/1973 | Vogel | 83/151 |
| 3,821,915 | * | 7/1974 | Larrable | 83/174 |
| 4,088,049 | * | 5/1978 | Benedict | 83/240 |
| 4,403,533 | * | 9/1983 | Cox et al. | 83/56 |
| 4,466,316 | * | 8/1984 | Kobayashi et al. | 83/13 |
| 4,754,674 | * | 7/1988 | Perlman | 83/422 |
| 4,779,500 | * | 10/1988 | Bennett et al. | 83/208 |
| 4,823,663 | * | 4/1989 | Hamlin | 83/208 |
| 4,827,818 | * | 5/1989 | Stringfellow | 83/440.2 |
| 4,926,727 | * | 5/1990 | Maeda | 83/203 |
| 5,442,983 | * | 8/1995 | D'Angelo et al. | 83/56 |
| 5,553,522 | * | 9/1996 | Boldrini et al. | 83/13 |
| 5,647,261 | * | 7/1997 | Wierenga | 83/649 |
| 5,823,083 | * | 10/1998 | Obertegger et al. | 83/175 |

* cited by examiner

*Primary Examiner*—Lee Young
*Assistant Examiner*—Minh Trinh
(74) *Attorney, Agent, or Firm*—John D. Lister

(57) ABSTRACT

A portable batt cutter custom cuts standard width, continuous, extended length fibrous insulation blankets at a construction site to form batts with specific dimensions corresponding to the dimensions of the structural framework cavities to be insulated. The portable batt cutter includes storage for retaining a fibrous insulation blanket; a feed mechanism for feeding the fibrous insulation blanket from the storage to a transverse cutter; and the transverse cutter which makes a transverse cut across the width of the fibrous insulation blanket to determine the length of the batt. The portable batt cutter may also include a cutter for making a longitudinal cut in the fibrous insulation blanket to form a batt having a width less than the width of the fibrous insulation blanket and a measuring device to measure the length of the batt prior to forming the transverse cut in the fibrous insulation blanket. The portable batt cutter has a size and weight enabling the cutter to be readily moved from construction site to construction site.

6 Claims, 2 Drawing Sheets

FIG. 3
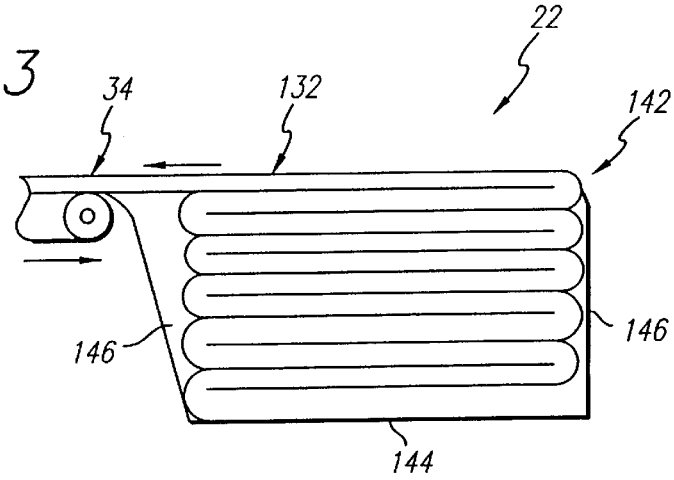
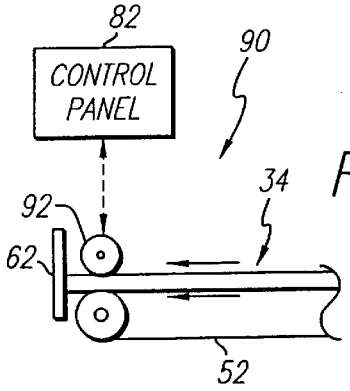
FIG. 4
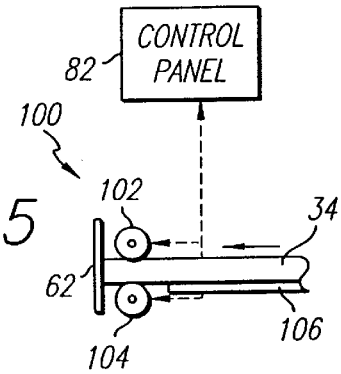
FIG. 5
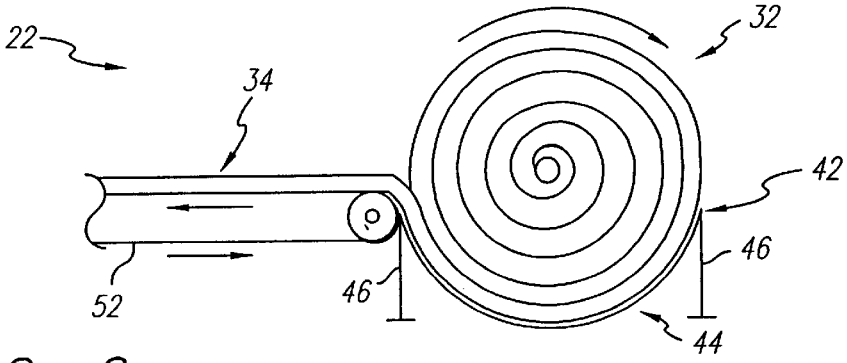
FIG. 6

PORTABLE BATT CUTTER

BACKGROUND OF THE INVENTION

The present invention relates to a portable batt cutter, and in particular, to a portable batt cutter which can cut extended lengths of standard width fibrous insulation blanket into batts sized in length and preferably both length and width to fit standard and non-standard size structural framework cavities.

Building structures, such as residential houses, industrial buildings, office buildings, mobile homes, prefabricated buildings, and similar structures typically include walls (both exterior and interior), ceilings, floors, and roofs which are insulated for thermal and/or acoustical purposes, especially the exterior walls and the roofs of such structures. The walls, ceilings, floors and roofs of these structures include framing members, e.g. studs, rafters, joists, beams, and similar support members, which are normally spaced-apart standard distances and, in the case of walls, form cavities having a standard length or height. Sheathing, paneling, lathing or similar construction materials are secured to the framing members to form the walls, ceilings, floors and roofs of the structures.

Building contractors seek to maintain the spacing between such framing members and the length or height of the framework cavities formed by such framing members at the standard widths and lengths (e.g. for the exterior wall of a residential house about fifteen inches in width by about ninety-seven inches in height) for ease of construction and installation of the insulation. However, frequently the cavities defined by the framing members in the walls, ceilings, floors and roofs of such buildings or structures have non-standard widths and lengths, e.g. the framing members are spaced apart distances less than the standard distance and/or the lengths or heights of the cavities are less or greater than a standard length or height for such cavities. Studies have shown that in a typical residential house built in the United States, it is common for 50% or more of the framing members in the exterior walls of these structures to be spaced apart at non-standard distances less than the standard spacing for such framing members and/or to define wall cavities having lengths or heights greater or less than the standard cavity height for such exterior wall cavities.

Thus, there has been a need to provide insulation batts at the construction site which are custom sized to fit standard width standard length cavities, non-standard width standard length cavities, non-standard width non-standard length cavities and standard width non-standard length cavities.

SUMMARY OF THE INVENTION

The portable batt cutter and method of the present invention provides a solution to the above problems by custom cutting standard width, continuous, extended length fibrous insulation blankets at a construction site to form batts with specific dimensions corresponding to the dimensions of the structural framework cavities to be insulated i.e. the extended length fibrous insulation blanket can be custom cut to form batts sized to fit standard width standard length cavities, non-standard width standard length cavities, non-standard width non-standard length cavities and standard width non-standard length cavities.

The portable batt cutter of the present invention includes storage for retaining a fibrous insulation blanket; a feed mechanism for feeding the fibrous insulation blanket from the storage to a transverse cutter; and the transverse cutter which makes a transverse cut across the width of the fibrous insulation blanket to determine the length of the batt. The portable batt cutter may also include a cutter for making a longitudinal cut in the fibrous insulation blanket to form a batt having a width less than the width of the fibrous insulation blanket and a measuring device to measure the length of the batt prior to forming the transverse cut in the fibrous insulation blanket. The portable batt cutter has a size and weight enabling the cutter to be readily moved from construction site to construction site.

BRIEF DESCRIPTION OF THE DRAWINGS

FIG. 3 is a schematic side elevation view of an alternative fibrous insulation storage station which can be used to hold Z-folded insulation in the portable batt cutter of the present invention.

FIG. 4 is a schematic side elevation view of an alternative pull and length measuring roll assembly which can be used in the portable batt cutter of the present invention.

FIG. 5 is a schematic side elevation view of another alternative pull and length measuring roll assembly which can be used in the portable batt cutter of the present invention.

FIG. 6 is a schematic side elevation view of an alternative fibrous insulation blanket storage station which can be used to hold a bulk roll of insulation in the portable batt cutter of the present invention.

DESCRIPTION OF THE PREFERRED EMBODIMENTS

Figure 1:
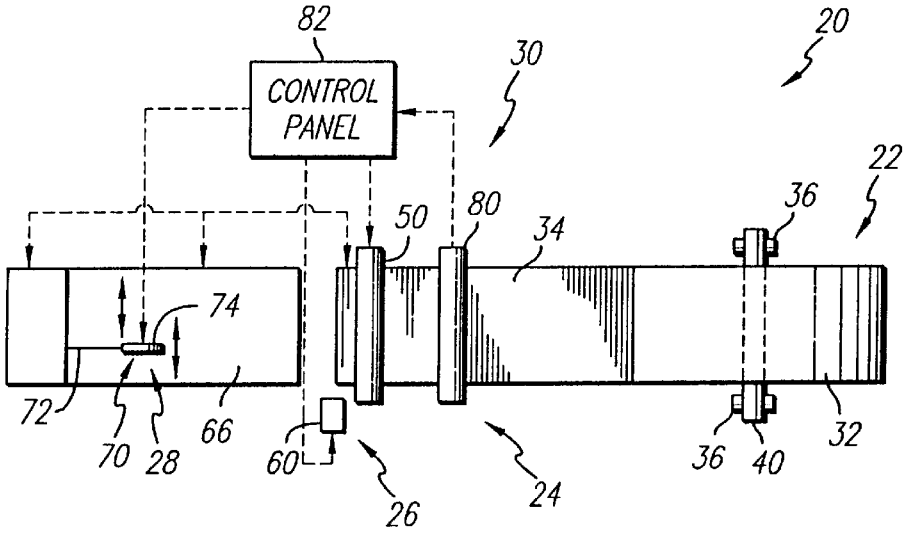
FIG. 1 is a schematic plan view of the portable batt cutter of the present invention.
Figure 2:
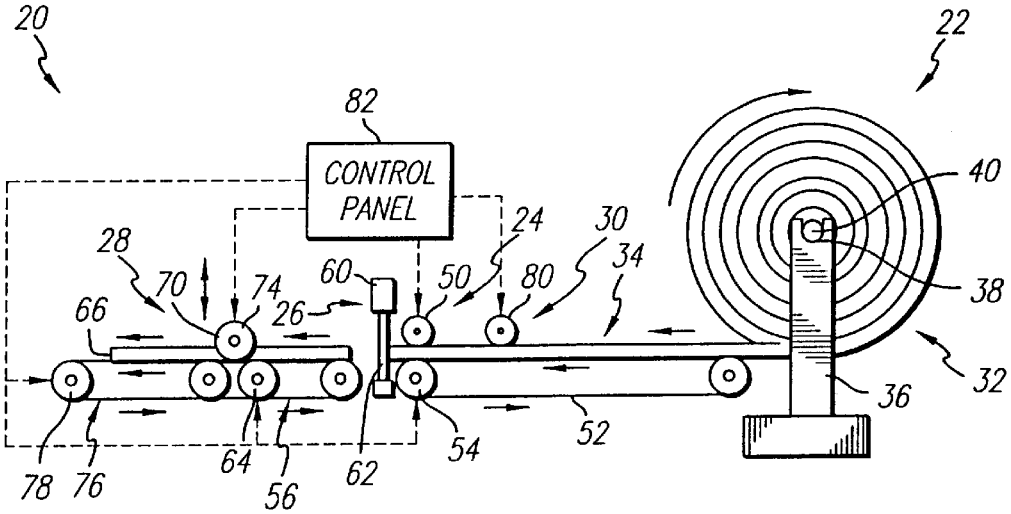
FIG. 2 is a schematic side elevation view of the portable batt cutter of FIG. 1.

FIGS. 1 and 2 schematically show the portable batt cutter 20 of the present invention. The portable batt cutter 20 includes a frame (not shown to better illustrate the other components of the portable batt cutter and its operation); a storage station 22; a feed mechanism 24; a transverse cutting station 26; a longitudinal cutting station 28; and a length measuring mechanism 30. The portable batt cutter 20 has a longitudinal centerline extending from the storage station through the longitudinal cutting station. In addition, the portable batt cutter 20 would have a weight and size (e.g. about two hundred pounds or less with a height of about thirty six inches, a width of about thirty six inches, and a length of about forty eight inches to about seventy two inches plus the length of any storage station such as those shown in FIGS. 2, 3 and 6) that would permit the portable batt cutter 20 to be readily moved from construction site to construction site, e.g. in the back of a pick-up truck.

As shown in FIGS. 1 and 2, the storage station 22 has a means for storing a bulk or jumbo roll 32 of standard width, continuous, extended length fibrous insulation blanket 34 which would typically have a length ranging from about thirty feet to about one hundred and fifty feet. The standard width for such fibrous insulation blankets 34 is approximately fifteen inches for wall cavities, such as but not limited to residential housing, and up to twenty four inches for other building structural framework cavities. As shown in FIGS. 1 and 2, the means (a yoke and axle assembly 35) for storing the bulk roll 32 includes a pair of yokes 36 with upwardly opening channels 38 which rotatably support an axle 40 passing through the core of a bulk or jumbo roll 32 of fibrous insulation blanket 34. However, other storage means that permit the fibrous insulation blanket 34 to be easily fed from the roll 32 while maintaining the roll in place can be used, such as the open top storage bin 42 shown in FIG. 6 with its width, height and semicircular bottom wall 44 sized to accommodate the largest bulk roll 32 being used in the portable batt cutter 20 and dispense the fibrous insulation blanket 34. The storage bin 42 has end walls 46 and may have two sidewalls, not shown, or may have only one sidewall or no sidewalls to facilitate loading a bulk roll 32 of insulation into the bin 42. With either of the storage means shown, as the fibrous insulation blanket 34 is pulled from the storage station 22 by the feed mechanism 24, the roll 32 rotates to supply the required amount of fibrous insulation blanket 34 from the roll.

Turning now to FIG. 3, FIG. 3 shows a storage bin 142 for storing and dispensing a Z-folded continuous, extended length fibrous insulation blanket 34 which can be substituted for the yoke and axle assembly 35, or the storage bin 44. The storage bin 142 permits the fibrous insulation blanket 34 to be easily fed from its Z-folded configuration 132 and has an open top with its width, height and bottom wall 144 sized to accommodate the largest bulk Z-folded continuous, extended length fibrous insulation blanket 34 being used in the portable batt cutter 20 and dispense the fibrous insulation blanket 34. The storage bin 142 has end walls 146 and may have two sidewalls, not shown, or may have only one sidewall or no sidewalls to facilitate loading a bulk Z-folded continuous, extended length fibrous insulation blanket 34 into the storage bin 142. With the storage bin 142, as the fibrous insulation blanket 34 is pulled from the storage station 22 by the feed mechanism 24, the layers of the fibrous insulation blanket are successively peeled off the Z-folded insulation 132 to supply the required amount of fibrous insulation blanket 34 from the storage station 22.

As shown in FIGS. 1 and 2, the feed mechanism 24 includes a pull roll 50 which extends perpendicular to the centerline of the portable batt cutter 20 and a continuous belt conveyor 52. The pull roll 50 and the belt conveyor 52 cooperate to the pull the fibrous insulation blanket 34 from the bulk roll 32 or Z-folded insulation 132 in the storage station 22 and feed the fibrous insulation blanket 34 to the transverse cutting station 26. Preferably, the pull roll 50 has a length and the belt conveyor 52 has a width equal to or greater than the widest fibrous insulation blanket 34 to be processed on the portable batt cutter 20. The pull roll 50 and preferably, a drive roll 54 of the belt conveyor 52 are each powered by a conventional electric motor (not shown). The underside of the pull roll 50 and the upper surface of the belt conveyor 52 are spaced apart a distance less than the thickness of the fibrous insulation blanket 34 being processed on the portable batt cutter 20 so that the blanket 34 is gripped between the underside of the pull roll 50 and the upper surface of the belt conveyor 52. Thus, as the pull roll 50 rotates and the belt conveyor 52 moves in the direction shown in FIG. 2, the pull roll and the belt conveyor cooperate to pull the fibrous insulation blanket 34 from the bulk roll 32 or the Z-folded insulation 132 and feed the fibrous insulation blanket 34 to the transverse cutting station 26. Preferably, the pull roll 50 and the drive roll 54 of the belt conveyor 52 are mounted so that the spacing between the underside of the pull roll 50 and the upper surface of the belt conveyor 52 can be adjusted e.g. by raising or lowering the pull roll 50 relative to the drive roll 54 by conventional means (not shown), to accommodate fibrous insulation blankets 34 of various thicknesses.

As schematically shown in FIGS. 1 and 2, the transverse cutting station 26 is located adjacent the pull roll 50 and the downstream end of the belt conveyor 52 of the feed mechanism 24 and intermediate the feed mechanism 24 and a second conveyor 56. The transverse cutting station 26 includes a cutting mechanism 60, such as but not limited to a conventional powered band saw or a powered circular saw, that is mounted to move back and forth across width of the portable batt cutter 20 in a direction perpendicular to the longitudinal centerline of the portable batt cutter for a distance equal to or greater than the width of the fibrous insulation blanket 34 to be processed on the portable batt cutter, e.g. for the entire width of the portable batt cutter 20. As shown in FIG.2, the saw blade 62 of the cutting mechanism 60 extends from above the horizontal plane of the upper surface of the fibrous insulation blanket 34 to below the horizontal plane of the upper surface of the belt conveyor 52 so that the cutting mechanism 60 cuts through the entire thickness of the fibrous insulation blanket as it passes transversely across the width of the portable batt cutter.

Preferably, the second belt conveyor 56 is a continuous belt conveyor; has a width equal to or greater than the widest fibrous insulation blanket 34 to be processed on the portable batt cutter 20; and has a drive roll 64 which is powered by a conventional electric motor (not shown). The second conveyor 56 can be operated simultaneously with the pull roll 50 and the feed conveyor 52 to move the fibrous insulation blanket 34 through the transverse cutting station 26 prior to making a transverse cut through the fibrous insulation blanket to form an insulation batt 66 of a selected length.

The second belt conveyor 56 also functions to move the fibrous insulation blanket 34 through the longitudinal cutting station 28 which can be used to form the insulation batt 66 to a selected width. The longitudinal cutting station 28 includes a cutting mechanism 70, such as but not limited to a conventional powered band saw or a powered circular saw. When making a longitudinal cut 72 in the fibrous insulation blanket to trim a portion of the fibrous insulation blanket 34 away to make the insulation batt 66 a selected width, the cutting mechanism 70 remains stationary as the fibrous insulation blanket 34 is fed through the longitudinal cutting station 28 by the belt conveyor 56. However, the cutting mechanism 70 is mounted to be moved or adjusted back and forth across width of the portable batt cutter 20, in a direction perpendicular to the longitudinal centerline of the portable batt cutter, for a distance equal to or greater than the width of the fibrous insulation blanket 34 to be processed on the portable batt cutter (e.g. for the entire width of the portable batt cutter 20) so that the cutting mechanism 70 can be located and set relative to the fibrous insulation blanket 34 to make the longitudinal cut 72 at the location required to make the insulation batt 66 a selected width. The saw blade 74 of the cutting mechanism 70 can be raised or moved laterally to an inoperative position outside of the path of the fibrous insulation blanket 34 where the saw blade 74 will not cut the fibrous insulation blanket 34. The saw blade can also be lowered and moved laterally (circular saw blade) or just moved laterally (band saw blade) to an operating position in the path of the fibrous insulation blanket 34 where the saw blade 74 extends from above the horizontal plane of upper surface of the fibrous insulation blanket to below the horizontal plane of the upper surface of the belt conveyor belt 56 so that the cutting mechanism 70 cuts through the entire thickness of the fibrous insulation blanket 74 as the blanket passes through the longitudinal cutting station 28 and trims the fibrous insulation blanket to the desired width for the insulation batt 66.

As shown in FIG. 2, there is a third belt conveyor 76 downstream of the longitudinal cutting station 28.

Preferably, the third belt conveyor 76 is a continuous belt conveyor; has a width equal to or greater than the widest fibrous insulation blanket 34 to be processed on the portable batt cutter 20; and has a drive roll 78 which is powered by a conventional electric motor (not shown). The second conveyor 76 can be operated simultaneously with the pull roll 50 and the feed conveyor 52, and the second belt conveyor 56 to move the fibrous insulation blanket 34 through the transverse cutting station 26 prior to making a transverse cut through the fibrous insulation blanket 34 to form an insulation batt 66 of a selected length. The third belt conveyor 76 also function to help move the fibrous insulation blanket 34 through the longitudinal cutting station 28, especially, when the longitudinal cutting station 28 is being used to form the insulation batt 66 to a selected width. While the portable batt cutter 20 is shown in FIG. 2 with a third belt conveyor 76, it is also contemplated that a flat sheet metal slide plate (not shown), which would lie in the same horizontal plane as the upper surface of the third belt conveyor, could be substituted for the third belt conveyor 76.

Preferably, the portable batt cutter is also provided with the length measuring mechanism 30 for measuring the length of the batt 66 to be formed by making the transverse cut through the fibrous insulation blanket 34 with the transverse cutting mechanism 60. As shown in FIGS. 1 and 2, the length measuring mechanism 30 includes a measuring roll 80 which extends perpendicular to the longitudinal centerline of the portable batt cutter 20 and the fibrous insulation blanket 34 being fed from the storage station 22 to the transverse cutting station 26. While the measuring roll 80 could be as short as one or two inches in length, as shown, the measuring roll 80 has a length equal to the length of the pull roll 50 and the belt conveyor 52. The measuring roll 80 is rotatably mounted above the upper surface of the feed conveyor 52 a distance less than the thickness of the fibrous insulation blanket 34 being processed through the portable batt cutter 20 so that as the fibrous insulation blanket is fed past the measuring roll the linear movement of the fibrous insulation blanket causes the measuring roll 80 to rotate. The measuring roll 80 is vertically adjustable relative to the upper surface of the belt conveyor 52 and has a known circumference. Accordingly, for each revolution of the measuring roll 80, the fibrous insulation blanket 34 has moved linearly beneath or past the measuring roll 80 a distance equal to the circumference of the measuring roll 80. The measuring roll 80 is connected to a conventional read out device which can be reset after each transverse cut and is calibrated to provide a reading of the length of the fibrous insulation blanket 34 that has been fed from the storage station 22 to the transverse cutting station 26 so that the length of the insulation batt 66 to be formed by a transverse cut of the transverse cutting mechanism 60 can be determined.

FIGS. 4 and 5 show alternative feed and measuring roll assemblies 90 and 100 respectively. In the feed and measuring roll assembly 90 of FIG. 4, the feed roll 92 also functions as the measuring roll rather than having a separate measuring roll 80 as shown in the embodiment of FIGS. 1 and 2. Otherwise, an embodiment of the portable batt cutter 20 using the feed and measuring roll assembly 90 is the same as the embodiment of FIGS. 1 and 2. In the feed and measuring roll assembly 100 of FIG. 5, preferably, the feed roll 102 also functions as the measuring roll rather than having a separate measuring roll 80 as shown in the embodiment of FIGS. 1 and 2. In addition, a pull roll 104 and a sheet metal slide plate 106 are substituted for the feed conveyor 52 with the pull rolls 102 and 104 cooperating to grip and pull the fibrous insulation blanket from the storage station 22 across the slide plate 106 and feed the fibrous insulation blanket 34 to the transverse cutting station 26. Otherwise, an embodiment of the portable batt cutter 20 using the feed and measuring roll assembly 100 is the same as the embodiment of FIGS. 1 and 2.

Preferably, the measuring roll 80 is electronically connected to a conventional electronic control panel 82 which can use the input from the measuring roll 80 to automatically control the portable batt cutter 20. For example, the electronic control panel 82 could have input terminals that permit the operator to set the length, width and number of the insulation batts 66 to be produced by cutting the fibrous insulation blanket 34. First the operator would manually feed a leading edge of the fibrous insulation blanket 34 over the belt conveyor 52 and past the measuring roll 80 and the pull roll 50 to the transverse cutting station 26 (positioning the leading edge of the fibrous insulation blanket 34 in the same transverse vertical plane as the saw blade 62 of the transverse cutting mechanism 60). Next the operator would input the desired length, width and number of the insulation batts 66 to be produced into the control panel 82. If the insulation batts 66 to be produced are to have a standard width, the control panel 82 sends a signal to the longitudinal cutting mechanism 70 to raise or laterally move the saw blade 74 of the longitudinal cutting mechanism to its inoperative position. If the insulation batts 66 to be produced are to have a non-standard width less than the standard width, the control panel 82 sends a signal to the longitudinal cutting mechanism 70 to move the saw blade 74 of the longitudinal cutting mechanism to the operative position required to trim away a predetermined part of the fibrous insulation blanket 34 to form insulation batts 66 having the desired widths. Next the control panel 82 automatically sends signals to actuate the pull roll 50, the drive roll 54 of the conveyor 52, and the drive rolls 64 and 78 20 of the conveyors 56 and 76 to move the leading edge of the fibrous insulation blanket 34 the required distance past the saw blade 62 of the transverse cutting mechanism 60 to produce insulation batts 66 having the desired length when the transverse cuts are made by the transverse cutting mechanism 60. At the same time the fibrous insulation blanket 34 is being moved into place for the transverse cut, the fibrous insulation blanket 34 is being fed at least part way through the longitudinal cutting mechanism 70 which is also actuated to thereby at least partially form any longitudinal cut to be formed in the fibrous insulation blanket 34 if insulation batts 66 of less than standard width are being produced. Once the fibrous insulation blanket 34 is properly located for a transverse cut, signals from the control panel 82 stop the pull roll 50, the drive roll 54 of the feed conveyor 52 and the drive rolls 64 and 78 of conveyors 56 and 76 to hold the fibrous insulation blanket 34 stationary while the transverse cut is made and another signal from the control panel actuates the transverse cutting mechanism 60 to move the transverse cutting mechanism 60 across the entire width of the portable batt cutter 20 to completely cut through the fibrous insulation blanket and separate a section of the fibrous insulation blanket of a selected length that is to become an insulation batt 66 from the fibrous insulation blanket 34 being fed into the transverse cutting station 26. Once the transverse cut is completed a signal from the control panel 82 stops the transverse cutting mechanism 60 and another signal from the control panel 82 actuates the drive rolls 64 and 78 of the conveyors 56 and 76 to complete the movement of the fibrous insulation blanket 34 through the longitudinal cutting station 28 and thereby complete any trimming of the fibrous insulation blanket 34 by the longitudinal cutting mechanism 70 to produce an insulation batt 66 of the desired width. The batt making cycle is then complete and another cycle can be commenced to form another insulation batt 66 having the same or different dimensions.

In describing the invention, certain embodiments have been used to illustrate the invention and the practices thereof. However, the invention is not limited to these specific embodiments as other embodiments and modifications within the spirit of the invention will readily occur to those skilled in the art on reading this specification. Thus, the invention is not intended to be limited to the specific embodiments disclosed, but is to be limited only by the claims appended hereto.

What is claimed is:

1. A portable batt cutter for custom cutting standard width, continuous, extended length fibrous insulation blankets at a construction site to form batts having specific dimensions corresponding to the dimensions of a structural framework cavity, comprising:

a portable unit including a storage means, a transverse cutting means, a longitudinal cutting means, length measuring means and a feed means; the portable unit having a longitudinal centerline;

the storage means being means for retaining a standard width, continous, extended length fibrous insulation blanket having a width, a length, a thickness, and a longitudinal centerline extending perpendicular to the width and parallel to the length of the fibrous insulation blanket;

the feed means being means for feeding the fibrous insulation blanket from the storage means through the transverse cutting means to the longitudinal cutting means, and through the longitudinal cutting means with the longitudinal centerline of the fibrous insulation blanket extending parallel to the longitudinal centerline of the portable unit;

the transverse cutting means being means including a powered band or circular saw for making a transverse cut, extending through the thickness of the fibrous insulation blanket and for the width of the fibrous insulation blanket, in a direction transverse to the longitudinal centerline of the portable unit and the fibrous insulation blanket;

the longitudinal cutting means being means including a powered band or circular for making a longitudinal cut in the fibrous insulation blanket, extending through the thickness of the fibrous insulation blanket and parallel to the longitudinal centerline of the fibrous insulation blanket, to form a fibrous insulation batt having a width less than the width of the fibrous insulation blanket; the powered band or circular saw of the longitudinal cutting means being moveable in a direction perpendicular to the longitudinal centerline of the portable unit and the fibrous insulation blanket to set the width of the fibrous insulation batt;

the length measuring means for measuring the length of a fibrous insulation batt to be formed by making a transverse cut in the fibrous insulation blanket with the transverse cutter means; and the portable unit having a size and weight enabling the portable unit to be readily moved from construction site to construction site.

2. The portable batt cutter according to claim 1, wherein: the feed means comprises pull roll means for pulling the fibrous insulation blanket from the storage means and feeding the fibrous insulation blanket to the transverse cutting means and through the longitudinal cutting means.

3. The portable batt cutter according to claim 2, wherein: the pull roll means includes the length measuring means which measures the length of the insulation batt to be formed by making the transverse cut in the fibrous insulation blanket by measuring the length of the fibrous insulation blanket being fed to the transverse cutting means.

4. The portable batt cutter according to claim 1, including: control means for operating the transverse cutting means to form a transverse cut in the fibrous insulation blanket when a selected length of the fibrous insulation blanket has been fed to the transverse cutting means to form a fibrous insulation batt of the selected length.

5. The portable batt cutter according to claim 1, wherein: the storage means is a means for retaining a roll of the continuous, extended length fibrous insulation blanket so that the roll can rotate to dispense lengths of fibrous insulation blanket from the roll.

6. The portable batt cutter according to claim 1, wherein: the storage means is a means for retaining a Z-folded layered continuous, extended length fibrous insulation blanket so that successive layers of the fibrous insulation blanket can be pulled from the layered continuous, extended length fibrous insulation blanket to dispense lengths of the fibrous insulation blanket.

* * * * *